US006714228B1

(12) United States Patent
Holland et al.

(10) Patent No.: US 6,714,228 B1
(45) Date of Patent: Mar. 30, 2004

(54) INK RIBBON CARTRIDGE WITH C-SHAPED SIDEPLATES

(75) Inventors: Carl William Holland, Webster, NY (US); Donald J. Watters, Fairport, NY (US)

(73) Assignee: Nu-kote International, Inc., Dallas, TX (US)

( * ) Notice: Subject to any disclaimer, the term of this patent is extended or adjusted under 35 U.S.C. 154(b) by 99 days.

(21) Appl. No.: 09/994,966

(22) Filed: Nov. 27, 2001

(51) Int. Cl.[7] ..... B41J 32/00
(52) U.S. Cl. ..... 347/214
(58) Field of Search ..... 347/214; 400/207, 400/208

(56) References Cited

U.S. PATENT DOCUMENTS

| | | | | |
|---|---|---|---|---|
| D355,436 | S | 2/1995 | Suwa | |
| 5,455,617 | A * | 10/1995 | Stephenson et al. | 347/214 |
| 5,547,298 | A * | 8/1996 | Wouters et al. | 400/207 |
| D383,743 | S | 9/1997 | Suwa et al. | |
| 5,775,821 | A | 7/1998 | Kato | |
| 5,865,545 | A * | 2/1999 | Kondo | 400/207 |
| 5,897,256 | A | 4/1999 | Kameyama | |
| 5,913,621 | A | 6/1999 | Kameyama et al. | |
| 5,961,229 | A | 10/1999 | Kameyama | |
| 5,984,546 | A | 11/1999 | Kameyama | |
| D425,545 | S | 5/2000 | Ishida | |
| 6,079,886 | A | 6/2000 | Kameyama | |
| 6,161,972 | A | 12/2000 | Kameyama et al. | |
| D442,211 | S | 5/2001 | Hayashi et al. | |
| 6,257,780 | B1 | 7/2001 | Ito et al. | |
| 2001/0046399 | A1 * | 11/2001 | Hayashi | 400/207 |

FOREIGN PATENT DOCUMENTS

| | | | | |
|---|---|---|---|---|
| EP | 0 852 182 | A1 | 7/1998 | |
| EP | 0 931 672 | A1 | 7/1999 | |
| EP | 0 852 182 | B1 | 11/1999 | |
| EP | 1 000 765 | A2 | 5/2000 | |
| JP | 10-193731 | * | 7/1998 | B41J/17/32 |
| JP | 11-05886 | * | 3/1999 | B41J/17/32 |
| JP | 2001026156 | A | 1/2001 | |

OTHER PUBLICATIONS

JP 2001026156 A—Japan (Abstract in English).

* cited by examiner

*Primary Examiner*—Huan Tran
(74) *Attorney, Agent, or Firm*—Fay, Sharpe, Fagan, Minnich & McKee LLP

(57) ABSTRACT

An ink cartridge includes a housing, an ink ribbon (120), spools (50, 60) for holding the ribbon, and spindles (70, 72, 90, 92) received within openings of the spools. The housing has semi-cylindrical sections (10, 12) which receive the spools. The housing further includes c-shaped sideplates (24, 26, 34, 36) with openings for each spindle. The c-shaped sideplates selectively expand to receive the spindles and retain the spindles in position.

22 Claims, 4 Drawing Sheets

INK RIBBON CARTRIDGE WITH C-SHAPED SIDEPLATES

BACKGROUND OF THE INVENTION

This invention relates generally to an ink ribbon cartridge for use with a printer or facsimile machine, and more particularly, to a thermal ink ribbon cartridge having one piece c-shaped sideplates which eliminate hinged connections and are easier to load ink ribbon. The invention provides for an ink ribbon cartridge which ensures proper, reliable mounting of an ink ribbon.

Generally an ink ribbon cartridge is used because of the simplicity of handling when a thermal printer is used to print on paper. However, when a thermal printer uses a large ink ribbon cartridge, it is uneconomical for the whole cartridge to be thrown away after use. To obviate this drawback, an ink ribbon alone is replaced. The ink ribbon typically includes a band-like sheath comprising a resin film with a layer of ink formed on one side and is wound around a pair of cardboard spools.

A prior art ink ribbon cartridge using this type of ink ribbon is constructed such that at the time of ink ribbon replacement, a cover is unhinged, the used ink ribbon is taken out, and four spindles are removed from notches in the cartridge housing and from ends of the spools. The housing includes covers over each of the spools which are attached to the frame of the housing by living hinges and are secured into place by snaps that must be manually manipulated to engage the covers in the frames of the housing. The covers are formed of two semi-cylindrical portions. The covers are locked into place by the snaps after the spools have been installed into the housing. Subsequently, the ink ribbon cartridge is mounted into a printer or facsimile system.

It is desired to provide an ink ribbon cartridge which does not have hinge members or snap members and is easy to load and unload with ink ribbon and spools. Accordingly, it is desirable to develop a new and improved ink ribbon cartridge which meets the above-stated needs and others and provide better, more advantageous overall results.

SUMMARY OF THE INVENTION

Generally speaking, the present invention relates to an ink ribbon cartridge which has a one-piece sideplate for installing and removing ink ribbon and spools.

More particularly, the invention relates to an ink ribbon cartridge which has a one piece c-shaped sideplate used to easily remove and install take-up and supply spools having ink ribbon attached thereto. Thus, there are no hinge members or lock snap features required to retain the spools and ink ribbon within the ink ribbon cartridge.

In particular, an ink cartridge includes a housing, an ink ribbon, first and second spools for holding the ribbon, and four spindles received within respective end openings in the spools. The housing has a first portion and a second portion which receive the first and second spools, respectively. The housing includes four openings which receive the spindles, particularly two c-shaped openings for each spindle. A pair of connecting members connect the first portion to the second portion. The first portion and second portions at least partially cover the spools. The first and second portions are spaced apart and generally parallel to each other and each have semi-cylindrical members.

The housing is formed of thermoplastic material and is of a one-piece construction. First and second portions each have wall members at opposite ends which are generally normal to a longitudinal axis of the portions and form the sideplates along with the connecting members. Each of the wall members is c-shaped and has an opening for receiving the spindles. The c-shaped walls selectively expand to receive the spindles. The first portion wall members are generally parallel to each other and second portion wall members are generally parallel to each other.

One advantage of the present invention is the provision of an ink ribbon cartridge having a one piece construction to minimize parts that is easy to manufacture.

Another advantage of the present invention is the provision of an ink ribbon cartridge which does not have any hinge members or snap lock features and is easy to load and unload with ink ribbon and spools.

Yet another advantage of the present invention is the provision of an ink ribbon cartridge which provides c-shaped openings which allow better retention of take-up spools and supply spools within the ink cartridge housing.

Still other aspects and advantages of the invention will become apparent to those skilled in the art upon a reading and understanding of the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
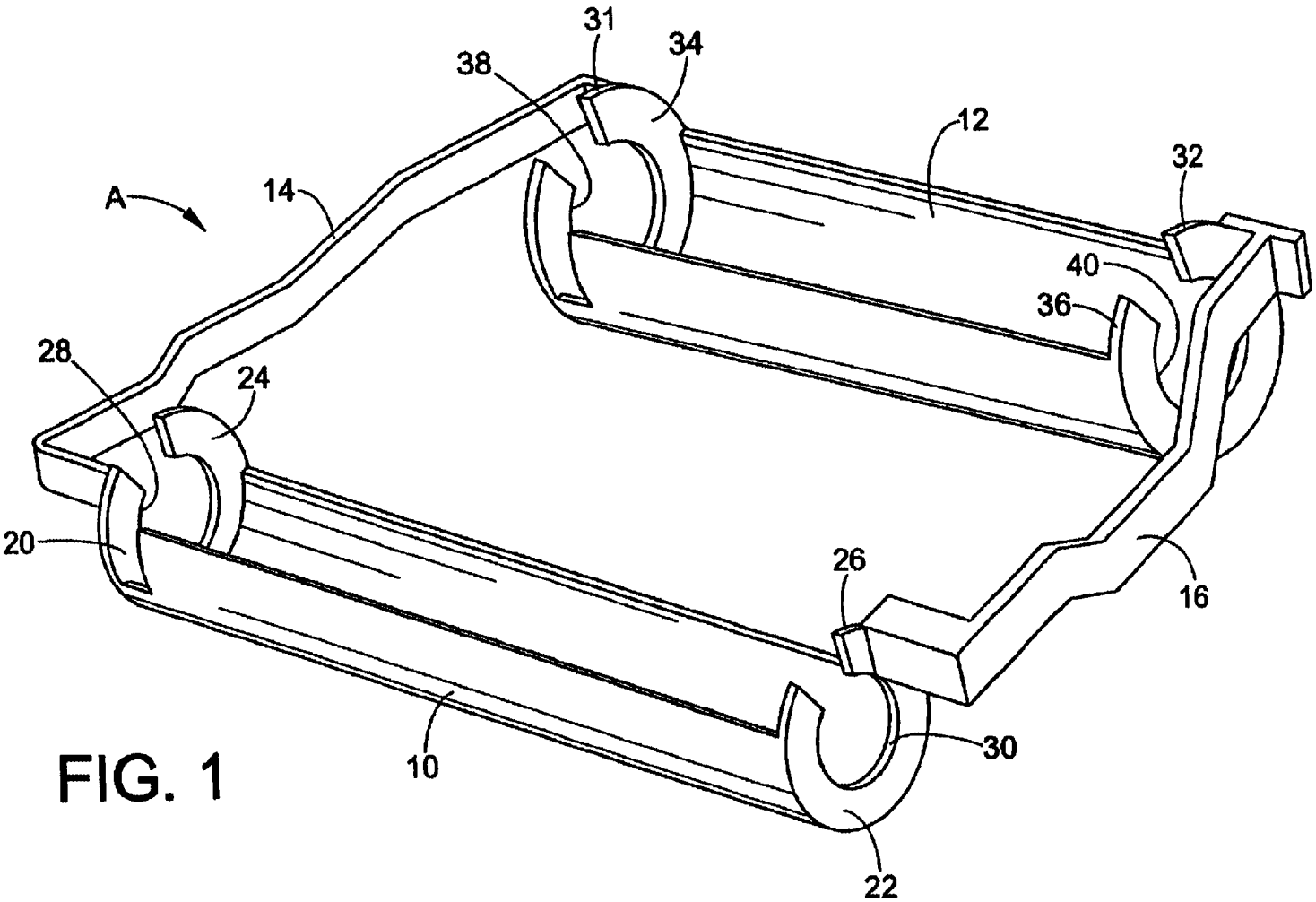
FIG. 1 is a perspective view of a one-piece ink ribbon cartridge housing having c-shaped sideplates in accordance with the preferred embodiment of the present invention.

Referring now to the drawings, wherein the showings are for purposes of illustrating the preferred embodiment of the invention only and not for purposes of limiting same, FIG. 1 shows an ink ribbon cartridge having a one-piece construction in accordance with the preferred embodiment of the present invention.

More particularly, the ink ribbon cartridge A has a housing comprising a first semi-cylindrical section 10, a second semi-cylindrical section 12, and connecting sections 14, 16 extending between and connecting the first and second semi-cylindrical sections. The ink ribbon cartridge housing is preferably unitarily molded of a resin or similar material. Each semi-cylindrical section 10, 12 extends along the length of either a supply spool or a take-up spool and partially covers each spool.

semi-cylindrical section 10 has a first end 20 and a second end 22. Each end 20, 22 has a wall or sideplate 24, 26, respectively. Each sideplate 24, 26 is c-shaped and has an opening 28, 30, respectively through a center of the sideplate for receiving a spindle extending from an end of a spool. Similarly, semi-cylindrical section 12 has a first end 31 and a second end 32 with sideplates or walls 34 and 36. Sideplate 34, 36 are also c-shaped and have openings 38, 40, respectively, formed in the center of the sideplates to receive spindles on the ends of the spools. Sideplates 24, 26 are spaced apart and generally parallel to each other and are approximately normal to a longitudinal axis of the semi-cylindrical section 10. Similarly, sideplates 34, 36 are spaced apart and generally parallel to each other and are approximately normal to a longitudinal axis of the semi-cylindrical section 12. The sideplates or walls are formed of a material that has some limited flexibility such that the openings can expand to receive the spindles therethrough and resiliently re-position to retain the spindle in position. Connecting section 14 interconnects sideplates 24, 34 and connecting section 16 likewise interconnects sideplates 26, 36 together. Connecting sections 14, 16 are spaced apart and generally parallel to each other. In FIG. 1, all of the c-shaped holes are shown to be approximately the same size; however, the openings may be of varying diameters without departing from the scope of the invention.

The ink ribbon cartridge is formed of a resilient material such that the c-shaped sideplates 24, 26, 34, 36 may be flexed or elastically deformed slightly to accommodate a spindle of a take-up spool.

Figure 2:
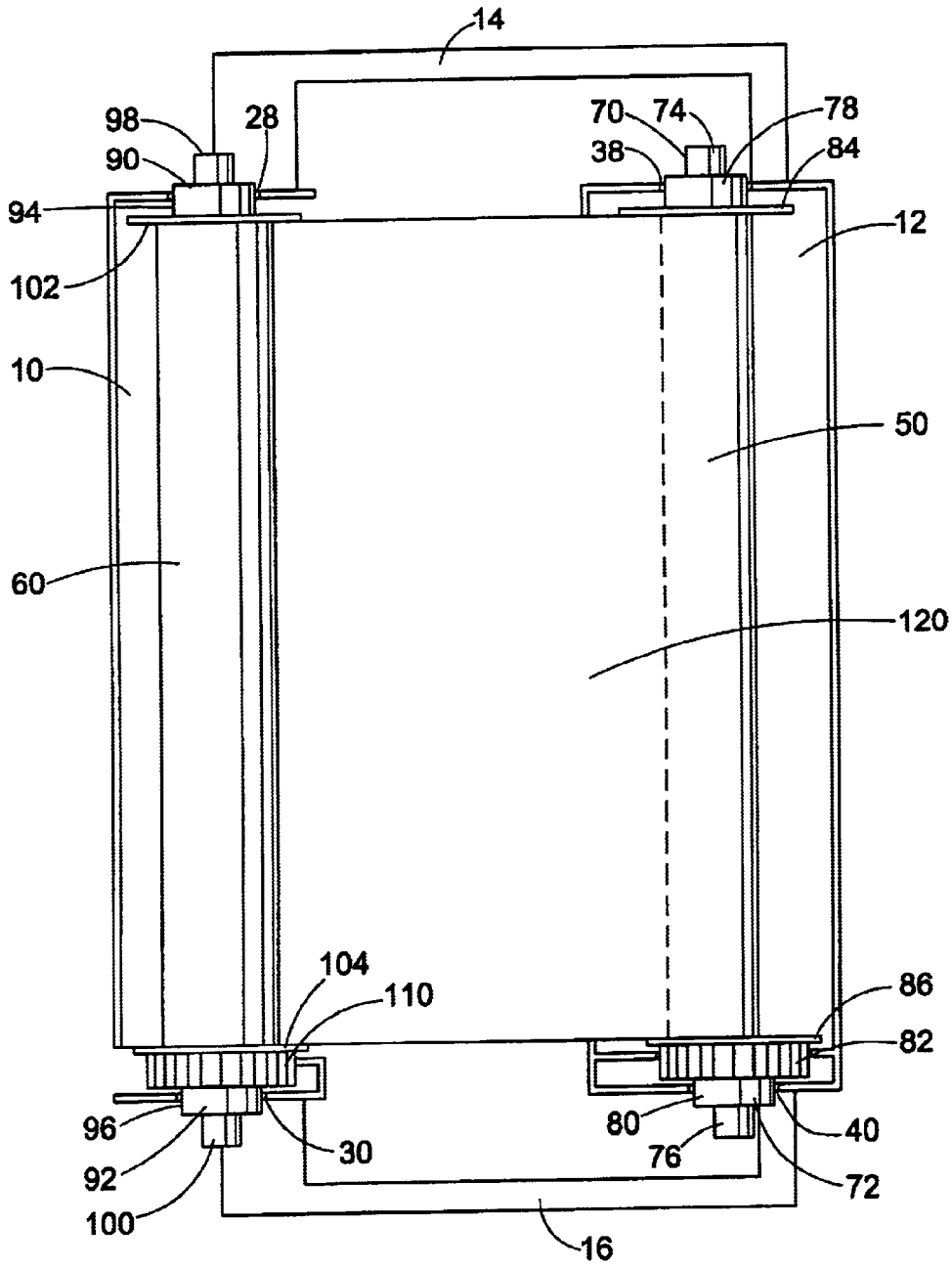
FIG. 2 is a top plan view of the ink ribbon cartridge of FIG. 1 with supply and take-up spools mounted therein.

Referring now to FIG. 2, a take-up spool 50 is received within semi-cylindrical section 12 and a supply spool 60 is received within semi-cylindrical section 10. Preferably, spools 50, 60 are made of cardboard. However, other materials may be used without departing from the scope of the present invention. Take-up spool 50 has a spindle 70 at one end and a spindle 72 at an opposite end. The spindles are preferably made of a resin or thermoplastic material. As seen in FIG. 2, each spindle has a cylindrical section 74, 76, respectively and a disk-shaped portion 78, 80, respectively, disposed adjacent thereto. Spindle 72 further comprises a gear portion 82 adjacent the disk-shaped portion. Each spindle further comprises a flat disk portion 84, 86, respectively, that has a diameter greater than the spool and sufficiently enlarged to retain the ink ribbon in wrapped relation thereto.

Spindle 70 is received by the opening 38 in sideplate 34 and spindle 72 is received in opening 40 of sideplate 36. As the spindles contact outer edges of the sideplates, the openings deflect or elastically deform to receive the spindle. That is, the terminal edges of the sideplate have a slightly smaller access opening than the outer diameter of the spindles. The spindle disk-shaped portions engage in a position within the openings. Once the spindles are fully seated within the openings, the c-shaped sideplates return to their original configuration and retain the spindle in place. Disk-shaped portions 78, 80 extend through the openings 38, 40, respectively.

Spool 60 has spindles 90, 92 at opposite ends thereof. As with the other spindles, spindles 90, 92 have disk-shaped portions 94, 96, and cylindrical portions 98, 100, respectively. Each spindle also has a flat disk portion 102, 104, respectively, disposed axially inward from the disk-shaped portions. Spindle 92 further has a gear portion 110. Disk-shaped portions 94, 96 are received by openings 28, 30. The c-shaped walls or sideplates and openings are elastically deformed and expand outwardly slightly to receive the spindles. The spindles then snap into place within the openings and are retained in place due to the c-shaped configuration. An ink ribbon 120 is wound around the supply spool and take-up spool and is selectively transferred from one to the other as the gears rotate the spindles during use of the printer/facsimile machine.

Figure 3:
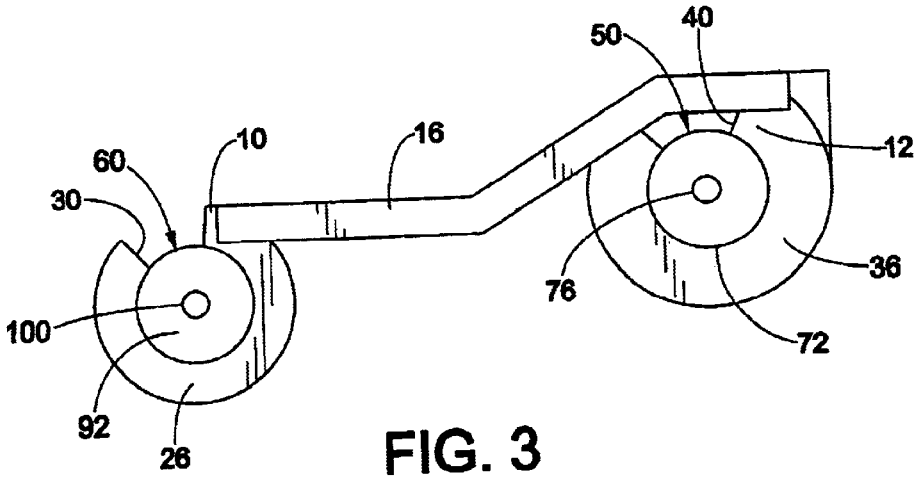
FIG. 3 is a side elevational view of the ink ribbon cartridge of FIG. 1 with supply and take-up spools installed therein; and, FIG. 4 is a bottom plan view of an ink ribbon cartridge of FIG. 1 having supply and take-up spools and an ink ribbon mounted therein.
Figure 4:
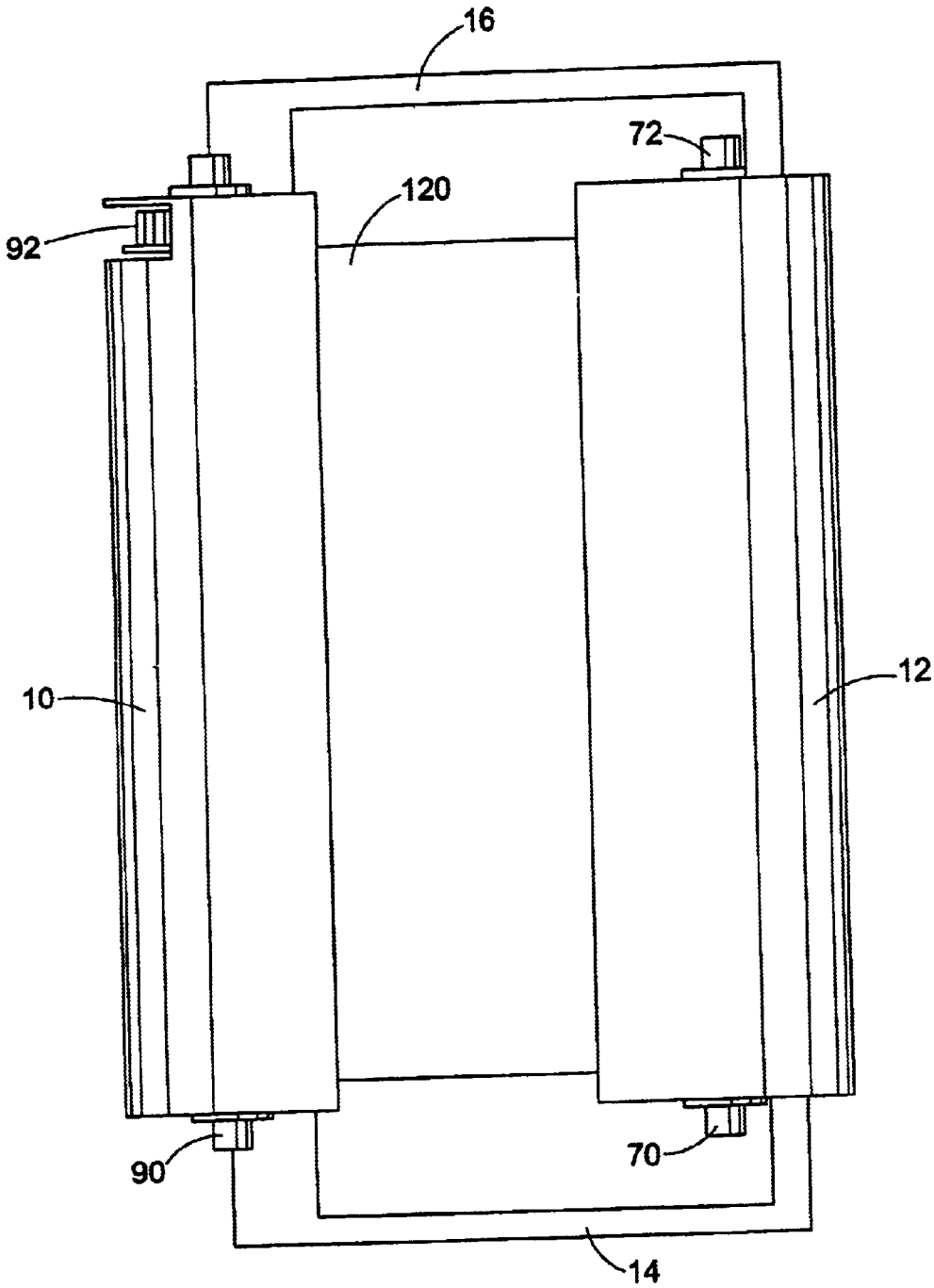

FIG. 3 illustrates the spindles 92, 72 installed in openings 30, 40 of semi-cylindrical sections 10, 12. FIG. 4 illustrates a bottom view of the ink ribbon cartridge showing the semi-cylindrical members 10, 12 covering at least a portion of spools 50, 60. As seen in FIG. 2, the gear spindles 92, 72 are preferably identical. However, gear spindles of different diameter or shape may be used without departing from the scope and intent of the present invention. Similarly, spindles 70, 90 are shown to have the same diameter disk portions. However, these spindles may have varying diameters and shapes without departing from the scope of the present invention.

To install spools 50, 60 along with the ink ribbon into the ink ribbon housing, the spindles are snap fit into the openings within the sideplates 24, 26, 34, 36. Once the spindle disk portions are received within the openings, the c-shaped openings of the sideplates return to their original configuration. Spindles are retained and locked into place within the openings of the sideplates. To remove the spools from the semi-cylindrical sections, the spindles and spools are then pulled away from the openings and again slightly expand the openings until a spindle can be removed from the openings. The spools are then removed from the ink ribbon housing.

The ink ribbon housing of the present invention thus eliminates the need for living hinges, or hinge members or snap arrangements which are conventionally used to retain the spindles and spools onto the ink ribbon housing. The ink ribbon housing may be compatible with a variety of dimensions of spindles and spools. The housing allows for easy removal and installation of spools and spindles and eliminates extra components for easier manufacture and lower cost.

The ink ribbon housing also prevents improper mounting of the spindles and spools on the housing. The ink ribbon housing openings also provide better retention of the spools within the housing. Alternately, the ink ribbon housings may be configured to have identical holes in each location to allow for spindles to be interchanged at different locations on either semi-cylindrical section 10 or 12.

The invention has been described with reference to a preferred embodiment. Obviously, alterations and modifications will occur to others upon a reading and understanding of this specification. It should be noted that variations on the configuration of the ink ribbon housing would fall within the scope and intent of the present invention. The specification is intended to include all such modifications and alterations insofar as they come within the scope of the appended claims or the equivalents thereof.

Having thus described the preferred embodiment, the invention is now claimed to be:

1. An ink ribbon cartridge, comprising:

an ink ribbon;

first and second spools holding said ribbon;

four spindles, wherein one of each of said spindles is received within an opening in an end of one of said spools;

a housing having a first portion and a second portion, said first portion receives said first spool and said second portion receives said second spool; each of said portions comprises a pair of sideplates each having a C-shaped configuration with a single C-shaped groove having an uninterrupted inner surface for receiving a spindle, wherein each C-shaped sideplate and corresponding groove selectively expands to receive a spindle.

2. The ink ribbon cartridge of claim 1, wherein said sideplates are spaced apart and are generally parallel to each other.

3. The ink ribbon cartridge of claim 1, wherein said first portion and said second portion each at least partially cover one of said spools.

4. The ink ribbon cartridge of claim 1, wherein said first portion and said second portion are spaced apart and are generally parallel to each other.

5. The ink ribbon cartridge of claim 4, wherein said first portion and said second portion each comprise semi-cylindrical members.

6. The ink ribbon cartridge of claim 1, wherein said housing comprises thermoplastic material.

7. The ink ribbon cartridge of claim 1, wherein said c-shaped sideplates are located at opposite ends of said portions, said sideplates are generally normal to a longitudinal axis of each portion.

8. The ink ribbon cartridge of claim 7, wherein said housing is a one-piece construction.

9. The ink ribbon cartridge of claim 8, wherein each of said grooves has the same size.

10. The ink ribbon cartridge of claim 8, wherein each of said grooves is of varying size.

11. The ink ribbon cartridge of claim 1, wherein each of said c-shaped sideplates has an edge which extends circumferentially beyond an outer edge of said first and second portions.

12. The ink ribbon cartridge of claim 1, wherein each of said c-shaped side plates have a c-shaped opening having an inner edge extending greater than 180 degrees.

13. A method of inserting a take-up spool and a supply spool into an ink ribbon cartridge housing, comprising the steps of:

inserting a first end of a take-up spool into a single C-shaped opening having an uninterrupted internal surface in a C-shaped sideplate of said housing;

deforming said C-shaped sideplate and said C-shaped opening to access and receive said take-up spool;

inserting a take-up spool second end opposite said first end in another single C-shaped opening in a C-shaped sideplate;

deforming said another sideplate and said corresponding opening to receive said take-up spool in said opening;

inserting a first end of a supply spool into a C-shaped opening in one of said sideplates;

deforming said C-shaped sideplate and said corresponding opening to receive said supply spool in said opening;

inserting a supply spool second end opposite said first said into a C-shaped opening in the other said sideplate;

deforming said C-shaped sideplate and said corresponding opening to receive said supply spool in said opening.

14. The method of claim 13, further comprising the steps of inserting a spindle into each end of said take-up spool and said supply spool.

15. The method of claim 14, further comprising the step of inserting said spindles in said openings of said sideplates.

16. An ink ribbon cartridge, comprising:

an ink ribbon;

first and second spools for holding said ribbon;

a plurality of spindles, one of each spindles is received by an opening in an end of one of said spools;

a housing having a pair of semi-cylindrical sections for receiving said first and second spools;

each of said semi-cylindrical sections comprises a pair of c-shaped sideplates having a continuous c-shaped opening for receiving an end of one of said spools, each sideplate having first and second ends; and a pair of connecting members extending between two of said sideplates, said connecting members extending from said first ends of each of said sideplates, wherein said sideplates expand from said second ends not attached to said connecting members.

17. The ink ribbon cartridge of claim 16, wherein said sideplates are spaced apart and are generally parallel to each other.

18. The ink ribbon cartridge of claim 16, wherein said first portion and said second portion each at least partially cover one of said spools.

19. The ink ribbon cartridge of claim 16, wherein said first portion and said second portion are spaced apart and are generally parallel to each other.

20.The ink ribbon cartridge of claim 16, wherein said housing is a one-piece construction.

21. The ink ribbon cartridge of claim 16, wherein each of said openings has the same size.

22. The ink ribbon cartridge of claim 16, wherein each of said openings is of varying size.

* * * * *